US011014380B2

(12) United States Patent
Yamada et al.

(10) Patent No.: US 11,014,380 B2
(45) Date of Patent: May 25, 2021

(54) IMAGE FORMING APPARATUS WITH PRE-HEAT AND POST-HEAT CONTROL

(71) Applicants: Masafumi Yamada, Kanagawa (JP); Osamu Kizaki, Saitama (JP); Shizuho Katahira, Kanagawa (JP); Junji Nakai, Kanagawa (JP)

(72) Inventors: Masafumi Yamada, Kanagawa (JP); Osamu Kizaki, Saitama (JP); Shizuho Katahira, Kanagawa (JP); Junji Nakai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/677,512

(22) Filed: Nov. 7, 2019

(65) Prior Publication Data

US 2020/0164662 A1 May 28, 2020

(30) Foreign Application Priority Data

Nov. 28, 2018 (JP) ..... JP2018-222223

(51) Int. Cl.
*B41J 11/00* (2006.01)
*B41J 2/045* (2006.01)

(52) U.S. Cl.
CPC ..... *B41J 11/002* (2013.01); *B41J 2/04563* (2013.01); *B41J 11/00242* (2021.01)

(58) Field of Classification Search
CPC ..... B41J 11/002
See application file for complete search history.

(56) References Cited

U.S. PATENT DOCUMENTS

| | | | | |
|---|---|---|---|---|
| 9,505,236 | B2 * | 11/2016 | Suzuki | B41J 11/002 |
| 2014/0232797 | A1 | 8/2014 | Onodera et al. | |
| 2015/0029255 | A1 * | 1/2015 | Ohnishi | B41J 2/01 347/16 |
| 2015/0346659 | A1 | 12/2015 | Nagayama et al. | |
| 2016/0167401 | A1 | 6/2016 | Ebihara et al. | |
| 2017/0266986 | A1 | 9/2017 | Yamada | |

(Continued)

FOREIGN PATENT DOCUMENTS

| | | |
|---|---|---|
| JP | 2003-228254 | 8/2003 |
| JP | 2006-243509 | 9/2006 |
| JP | 2014-184711 | 10/2014 |

(Continued)

*Primary Examiner* — Sharon Polk
(74) *Attorney, Agent, or Firm* — Duft & Bornsen, PC

(57) ABSTRACT

A heating device includes a pre-heater configured to pre-heat a medium, onto which a liquid is discharged from a liquid discharger, at a first position upstream of the liquid discharger in a conveyance direction of the medium, a print-heater configured to heat the medium at a second position opposite the liquid discharger, a post-heater configured to post-heat the medium at a third position downstream of the second position in the conveyance direction, and circuitry configured to control a temperature of each of the pre-heater, the print-heater, and the post-heater. The pre-heater includes a first pre-heater and a second pre-heater disposed closer to the print-heater than the first pre-heater, and the circuitry controls a temperature of the second pre-heater to be between a temperature of the first pre-heater and the temperature of the print-heater.

14 Claims, 6 Drawing Sheets

(56) References Cited

U.S. PATENT DOCUMENTS

| | | | |
|---|---|---|---|
| 2019/0100032 | A1 | 4/2019 | Nakai et al. |
| 2019/0217623 | A1 | 7/2019 | Nagatsuka |

FOREIGN PATENT DOCUMENTS

| | | |
|---|---|---|
| JP | 2015-128876 | 7/2015 |
| JP | 2016-005881 | 1/2016 |
| JP | 2016-112728 | 6/2016 |
| JP | 2018-058373 | 4/2018 |

* cited by examiner

IMAGE FORMING APPARATUS WITH PRE-HEAT AND POST-HEAT CONTROL

CROSS-REFERENCE TO RELATED APPLICATION

This patent application is based on and claims priority pursuant to 35 U.S.C. § 119(a) to Japanese Patent Application No. 2018-222223, filed on Nov. 28, 2018, in the Japan Patent Office, the entire disclosure of which is incorporated by reference herein.

BACKGROUND

Technical Field

The present disclosure relates to a heating device and a liquid discharge apparatus.

Discussion of the Background Art

An image forming apparatus that performs image formation such as printing on a recording medium applies tension to the recording medium to move the recording medium along a conveyance path. Such an image forming apparatus includes conveyance rollers arranged along the conveyance path of the recording medium, a driving device that rotationally drives the conveyance rollers, and a drying device that dries ink discharged to the recording medium.

The drying device includes a plurality of heaters on the conveyance path of the recording medium to dry the recording medium according to a characteristic of a surface of the recording medium on which an image is formed.

SUMMARY

In an aspect of the present disclosure, a heating device includes a pre-heater configured to pre-heat a medium, onto which a liquid is discharged from a liquid discharger, at a first position upstream of the liquid discharger in a conveyance direction of the medium, a print-heater configured to heat the medium at a second position opposite the liquid discharger, a post-heater configured to post-heat the medium at a third position downstream of the second position in the conveyance direction, and circuitry configured to control a temperature of each of the pre-heater, the print-heater, and the post-heater. The pre-heater includes a first pre-heater and a second pre-heater disposed closer to the print-heater than the first pre-heater, and the circuitry controls a temperature of the second pre-heater to be between a temperature of the first pre-heater and the temperature of the print-heater.

In another aspect of the present disclosure, a heating device includes a pre-heater configured to pre-heat a medium, onto which a liquid is discharged from a liquid discharger, at a first position upstream of the liquid discharger in a conveyance direction of the medium, a print-heater configured to heat the medium at a second position opposite the liquid discharger downstream of the first position, a post-heater configured to post-heat the medium at a third position downstream of the second position in the conveyance direction, and circuitry configured to control a temperature of each of the pre-heater, the print-heater, and the post-heater. The post-heater includes a first post-heater adjacent to the print-heater and a second post-heater disposed farther from the print-heater than the first post-heater, and the circuitry controls a temperature of the first post-heater to be between a temperature of the second post-heater and the temperature of the print-heater.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
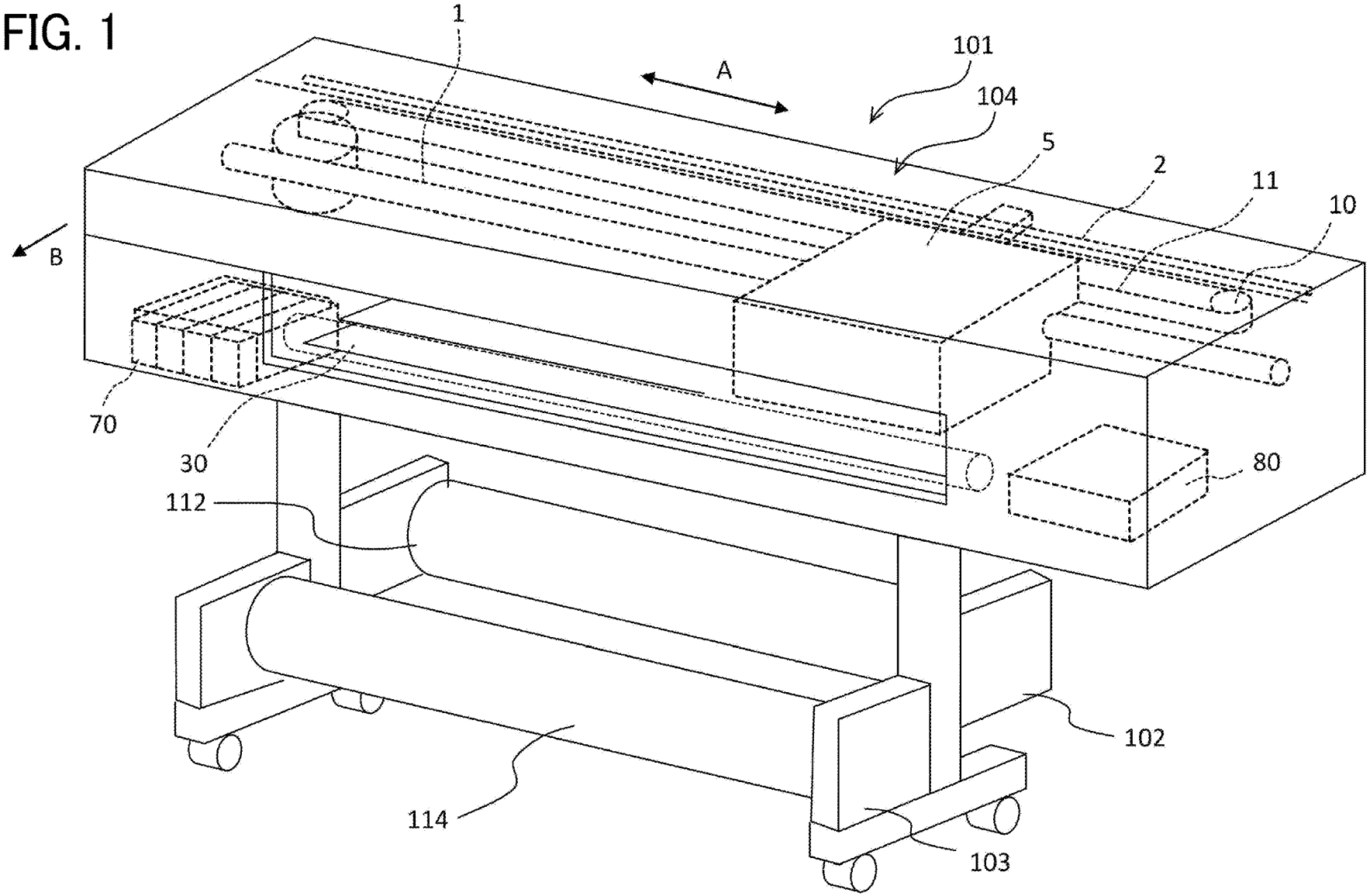
FIG. 1 is a perspective view illustrating a schematic configuration of an image forming apparatus according to an embodiment of the present disclosure.

The accompanying drawings are intended to depict embodiments of the present disclosure and should not be interpreted to limit the scope the present disclosure. The accompanying drawings are not to be considered as drawn to scale unless explicitly noted.

DETAILED DESCRIPTION

In describing embodiments illustrated in the drawings, specific terminology is employed for the sake of clarity. However, the present disclosure is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of the present disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions are omitted below.

Figure 2:
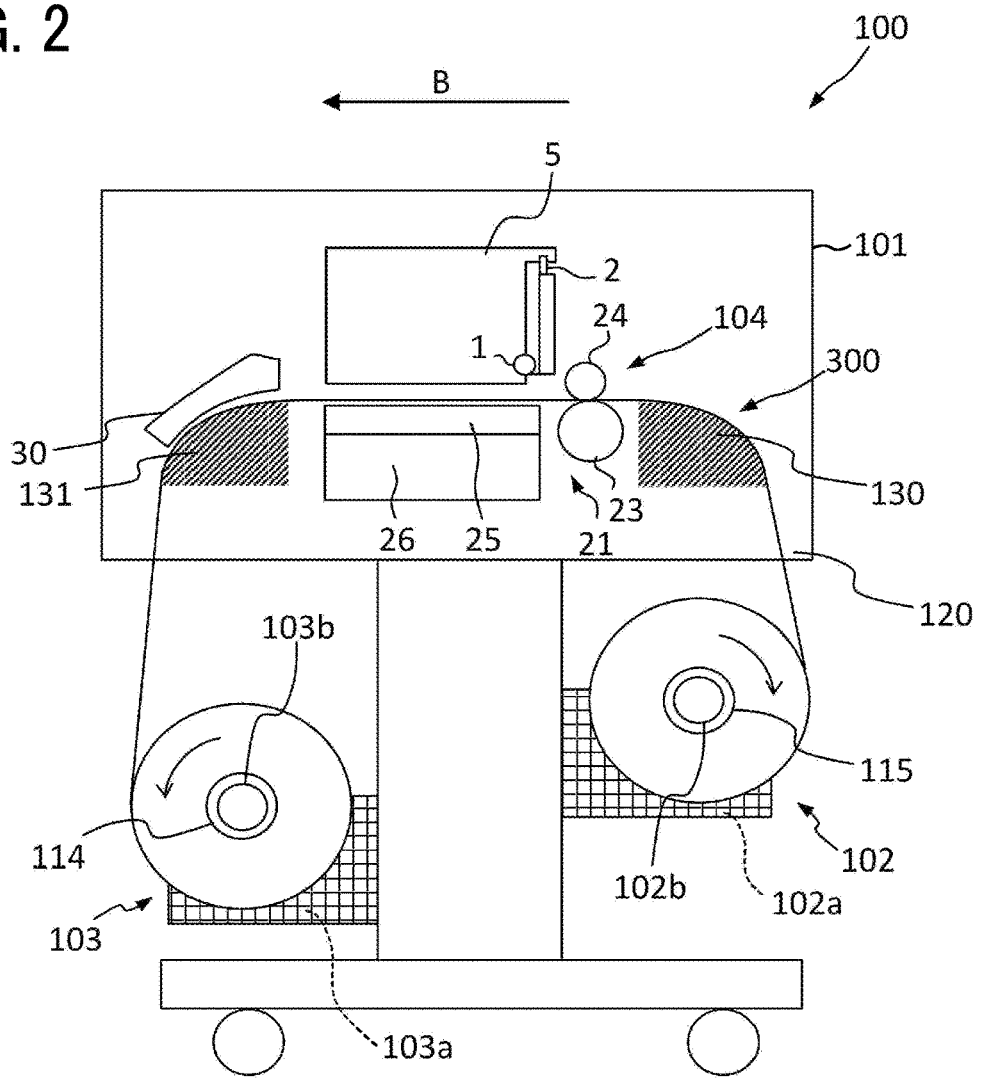
FIG. 2 is a schematic diagram illustrating the image forming apparatus according to the embodiment of the present disclosure as seen from the side.
Figure 3:
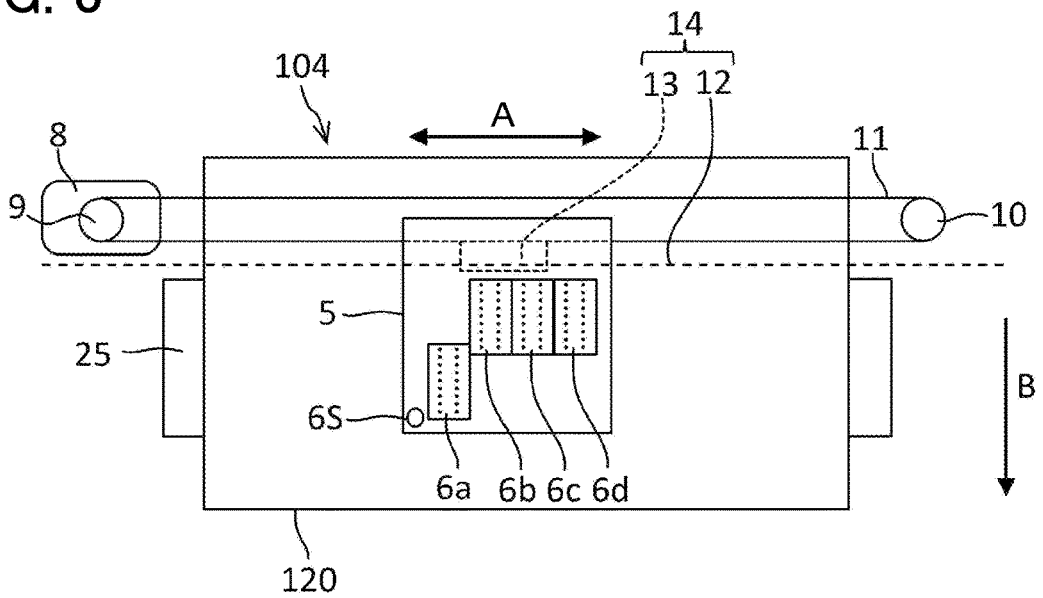
FIG. 3 is a plan view illustrating a schematic configuration of an image forming device according to the embodiment of the present disclosure.

In the following description, the same reference sign is assigned to the same configuration in the drawings, and the description is not repeated. FIG. 1 is a partially transparent view illustrating a schematic configuration of an inkjet recording apparatus 100 which is one embodiment of an image forming apparatus according to the present disclosure as seen from obliquely above. FIG. 2 is a schematic diagram illustrating the inkjet recording apparatus 100 as seen from the side. FIG. 3 is a partially transparent plan view illustrating a substantial part of an image forming device 104 included in the inkjet recording apparatus 100.

As illustrated in FIG. 1, the inkjet recording apparatus 100 includes an apparatus body 101, a feeding device 102, and a winding device 103. A conveyed object which is a medium is a sheet-shaped object cable of being wound into a roll shape. For example, a paper sheet, coat paper, heavy paper, an overhead projector (OHP) sheet, a plastic film, a prepreg, silver foil or the like are included. In the present disclosure, roll paper 120 obtained by rolling paper is described as an example.

The feeding device 102 holds a roll body 112 obtained by winding the paper sheet around a hollow shaft 115. The winding device 103 includes a hollow shaft 114 for winding the paper sheet. The roll body 112 is wound around the hollow shaft 114. The feeding device 102 and the winding device 103 may be formed not separately from but integrally with the apparatus body 101.

The feeding device 102 feeds the roll paper 120 into the apparatus body 101. In the apparatus body 101, the image forming device 104 which forms an image on the roll paper 120 fed in a conveyance direction indicated by arrow B in FIG. 1 is arranged.

In the image forming device 104, a guide rod 1 and a guide stay 2 which are guide members are bridged over both side plates. The guide rod 1 and the guide stay 2 support a carriage 5 so as to be movable in a main-scanning direction indicated by arrow A in FIG. 1. The winding device 103 winds the roll paper 120 on which the image is formed.

On one side in the main-scanning direction, a main-scanning motor 8 which is a driving source for reciprocating the carriage 5 is arranged. A timing belt 11 is stretched around a driving pulley 9 rotationally driven by the main-scanning motor 8 and a driven pulley 10 arranged on the other side in the main-scanning direction. To the timing belt 11, a belt holder of the carriage 5 is secured, and the main-scanning motor 8 is driven to reciprocate the carriage 5 in the main-scanning direction.

The carriage 5 mounts a plurality of (herein, four) recording heads 6*a* to 6*d* and a media detection sensor 6*s* that detects presence of the recording medium such as the roll paper 120 in a second position at which the liquid is discharged onto the recording medium from the recording heads 6*a* to 6*d* on the carriage 5. Each of the plurality of recording heads 6*a* to 6*d* includes a liquid discharge head and a head tank together forming a single unit. The head tank supplies liquid to the liquid discharge head. Therefore, the carriage 5 serves as a liquid discharger.

Herein, the recording head 6*a* and the recording heads 6*b* to 6*d* are arranged with a positional shift by one head (one nozzle row) in a sub-scanning direction orthogonal to the main-scanning direction. The recording heads 6*a* to 6*d* are mounted with a nozzle row including a plurality of nozzles which discharges the liquid arranged in the sub-scanning direction such that a droplet discharge direction is a direction downward.

Each of the recording heads 6*a* to 6*d* includes a plurality of (for example, two) nozzle rows. The recording heads 6*a* and 6*b* discharge black liquid of the same color from every nozzle row. The recording head 6*c* discharges cyan liquid from one nozzle row, and the other nozzle row is an unused nozzle row. The recording head 6*d* discharges yellow liquid from one nozzle row and discharges magenta liquid from the other nozzle row.

As a result, for monochrome images, the recording heads 6*a* and 6*b* may be used to form an image of a width of two heads in the main-scanning direction of one scan. For color images, for example, the recording heads 6*b* to 6*d* may be used to form an image. A head configuration is not limited to the present disclosure, and all of a plurality of recording heads may be arranged in the main-scanning direction.

An encoder sheet 12 is arranged in a moving direction (main-scanning direction) of the carriage 5, and the carriage 5 includes an encoder sensor 13 which reads the encoder sheet 12. The encoder sheet 12 and the encoder sensor 13 form a linear encoder 14. A position and a speed of the carriage 5 are detected from an output of the linear encoder 14.

In a recording area out of a main-scanning area of the carriage 5, the roll paper 120 is fed from the feeding device 102. Then, the roll paper 120 is intermittently conveyed by a conveyer 21 in the sub-scanning direction (paper conveyance direction) orthogonal to the main-scanning direction of the carriage 5.

The head tanks of the recording heads 6*a* to 6*d* are supplied with ink of respective colors from ink cartridges 70 which are main tanks mounted so as to replaceable on the apparatus body 101 via supply tubes. A maintenance unit 80 which maintains and recovers the recording heads 6*a* to 6*d* is arranged to the side of a conveyance guide member 25 on one side in the main-scanning direction of the carriage 5.

As illustrated in FIG. 2, the conveyer 21 includes a conveyance roller 23 which conveys the roll paper 120 fed from the feeding device 102, a pressure roller 24 arranged so as to be opposed the conveyance roller 23, a sub-scanning sensor 21*a* (refer to FIG. 5) including an encoder or the like which detects a conveyance amount of the roll paper 120, and a sub-scanning motor 21*b* (refer to FIG. 5) which rotates the conveyance roller 23.

The conveyance roller 23 and the pressure roller 24 form a conveyance controller. The conveyance guide member 25 having a plurality of suction holes and a suction fan 26 as a suction device which performs suction from the suction holes of the conveyance guide member 25 are provided on a downstream side of the conveyance roller 23. On a downstream side of the conveyer 21, a cutter is arranged as a cutting device which cuts the roll paper 120 on which the image is formed by the recording heads 6*a* to 6*d* at a predetermined length.

The roll body 112 of the feeding device 102 is obtained by winding long sheet-shaped roll paper 120 around the hollow shaft 115 such as a paper tube as a core member. Both the roll body 112 in which a trailing end of the roll paper 120 is secured to the hollow shaft 115 by bonding such as gluing and a non-fixed type in which the trailing end of the roll paper 120 is not bonded to the hollow shaft 115 may be herein mounted.

The feeding device 102 includes a feeding sensor 102*a* which detects a feeding amount of the roll paper 120 by the feeding device 102 and a feeding roller 102*b*. The feeding roller 102*b* rotates by driving of a feeding motor 102*c* (refer to FIG. 5). The winding device 103 includes a winding sensor 103*a* which detects a winding amount of the roll paper 120 by the winding device 103 and a winding roller 103*b*. The winding roller 103*b* rotates by driving of a winding motor 103*c* (refer to FIG. 5).

Therefore, the roll paper 120 sent out from the feeding device 102 is conveyed by the conveyer 21 immediately below the image forming device 104 at which an image is formed onto the roll paper 120, and is wound by the winding device 103.

The apparatus body 101 includes a liquid dryer 30 formed of a heater or the like for drying ink or the like which represents the image on the roll paper 120. The apparatus body 101 further includes a heating dryer 300 formed of a heater or the like for heating the roll paper 120 during conveyance. Therefore, the inkjet recording apparatus 100 also serves as a recording medium heating device. The heating dryer 300 is described later in detail.

A controller 200 (see FIG. 5) to be described later controls the driving of the feeding motor 102*c* and the winding motor 103*c*. Thus, the controller 200 controls the conveyance of the roll paper 120 so that constant tension is applied to the roll paper 120. During conveyance of the roll paper 120, since constant torque is applied to the roll paper 120 during the conveyance, the roll paper 120 may be conveyed without slack. Both the feeding roller 102*b* and the winding roller 103*b* rotate in directions of arc-shaped arrows in FIG. 2.

As illustrated in FIG. 2, on the apparatus body 101 side, a guide member 130 which guides the roll paper 120 drawn from the roll body 112 of the feeding device 102 and a paper ejection guide member 131 which guides the roll paper 120 after being sucked downstream of the conveyance guide member 25 are arranged. The winding device 103 includes the hollow shaft 114 such as a paper tube as a core member. A leading end of the roll paper 120 is bonded to the hollow shaft 114 with a tape or the like.

The inkjet recording apparatus 100 moves the carriage 5 in the main-scanning direction when forming the image, and intermittently conveys the roll paper 120 drawn out from the roll body 112 of the feeding device 102 and guided along the guide member 130 by the conveyer 21.

The recording heads 6*a* to 6*d* are driven in accordance with image information (printing information) to discharge the liquid. The recording heads 6*a* to 6*d* thus form a required image on the roll paper 120. The roll paper 120 on which the image is formed is guided by the paper ejection guide member 131 and wound around the hollow shaft 114 in the winding device 103. The roll paper 120 on the conveyance roller 23 is conveyed while the tension is applied onto the roll paper 120 from each of the feeding device 102 side and the winding device 103 side.

In the above description, the inkjet recording apparatus 100 including the feeding device 102 which holds the roll body 112 is the embodiment of the present disclosure. An aspect of the image forming apparatus according to the present disclosure is not limited to the present disclosure. For example, the present disclosure may also be an apparatus which discharges liquid (liquid discharge apparatus) including the feeding device 102 which holds the roll body 112.

The liquid discharge apparatus includes a liquid discharge head or a liquid discharge device and drives the liquid discharge head to discharge liquid. Examples of the liquid discharge apparatus include not only an apparatus capable of discharging the liquid to a material to which the liquid may adhere but also an apparatus which discharges the liquid toward gas or into liquid.

The liquid discharge apparatus may include devices of feeding, conveying, and ejecting the material to which the liquid may adhere and also include a pre-treatment device and a post-treatment device. Examples of the liquid discharge apparatus include, for example, an image forming apparatus which discharges ink to form an image on a paper sheet, and a stereoscopic fabrication apparatus (three-dimensional fabrication apparatus) which discharges fabrication liquid to a powder layer obtained by forming powder into a layer for fabricating a stereoscopic fabrication object (three-dimensional fabrication object).

The liquid discharge apparatus is not limited to an apparatus which visualizes a meaningful image such as a character or a figure by the discharged liquid. For example, an apparatus which forms a meaningless pattern, or an apparatus which fabricates a three-dimensional image are also included.

The material to which the liquid may adhere is intended to mean the material to which the liquid may adhere at least temporarily, the material to which the liquid adheres to be fastened or the material to which the liquid adheres to permeate. Specific examples include recording media such as a paper sheet, recording paper, a recording paper sheet, a film, and cloth, electronic components such as an electronic substrate and a piezoelectric element, and media such as a powder layer, an organ model, and a testing cell; all the materials to which the liquid adheres are included unless limited in particular.

The above-described material onto which the liquid may adhere may be any material as long as the liquid may adhere onto the material even if temporarily such as paper, thread, fiber, cloth, leather, metal, plastic, glass, wood, ceramics, building materials such as wallpaper and flooring, and textiles for clothing. The liquid includes ink, treatment liquid, a DNA sample, a resist, a pattern material, a binder, fabrication liquid, or a solution containing amino acid, protein, calcium, and a dispersion liquid.

The liquid discharge apparatus may be an apparatus in which the liquid discharge head and the material to which the liquid may adhere relatively move; however, the present disclosure is not limited to such an apparatus. Specific examples include a serial type apparatus which moves the liquid discharge head, and a line type apparatus which does not move the liquid discharge head.

Examples of the liquid discharge apparatus further include a treatment liquid applying apparatus which discharges the treatment liquid to the paper sheet for applying the treatment liquid to a paper sheet surface in order to reform the paper sheet surface. The liquid discharge apparatus may also include an injection granulation apparatus which injects composition liquid obtained by dispersing a raw material in a solution via a nozzle to granulate fine particles of the raw material.

The liquid discharge device described above is obtained by integrating a functional part and a mechanism with the liquid discharge head, and is an assembly of parts relating to liquid discharge. For example, the liquid discharge device includes a combination of the liquid discharge head with at least one of a head tank, a carriage, a supply mechanism, a maintenance unit, and a main scan moving unit.

Examples of integrating herein include, for example, securing of the liquid discharge head, functional part, and mechanism by fastening, bonding, or engaging, and holding of one so as to be movable with respect to the other. The liquid discharge head, functional part, and mechanism may be detachably attached to one another.

Examples of the liquid discharge device include, for example, the liquid discharge head and the head tank together forming a single unit. The liquid discharge device may be a unit in which the liquid discharge head and the head tank are connected to each other with a tube to form a single unit.

A unit including a filter between the head tank and the liquid discharge head of the liquid discharge device may also be herein added. Examples of the liquid discharge device include the unit in which the liquid discharge head and the carriage are integrated.

Examples of the liquid discharge device further include the unit in which a guide member forming a part of a main scan moving unit is allowed to hold the liquid discharge head so as to be movable, and the liquid discharge head and the main scan moving unit are integrated. Examples of the liquid discharge device include the unit in which the liquid discharge head, the carriage, and the main scan moving unit are integrated. The main scan moving unit also includes a single piece of guide member.

Examples of the liquid discharge device further include the unit in which a cap member which forms a part of the maintenance unit is secured to the carriage on which the liquid discharge head is mounted, and the liquid discharge head, the carriage, and the maintenance unit are integrated.

The liquid discharge device may also include a tube connected to the liquid discharge head to which the head tank or a channel part is attached, and the liquid discharge head and the supply mechanism together form the liquid discharge device as a single unit. The supply mechanism also includes a single piece of tube or loading unit.

A pressure generator to be used in the liquid discharge head is not limited. For example, a piezoelectric actuator (layered piezoelectric element) may also be used. Other than the piezoelectric actuator, a thermal actuator which uses a thermoelectric conversion element such as a heating resistor, and an electrostatic actuator including a diaphragm and opposite electrodes may also be used. The terms "image formation", "recording", "image printing", "printing", and "fabrication" used in the present disclosure are synonyms with each other.

Figure 4:
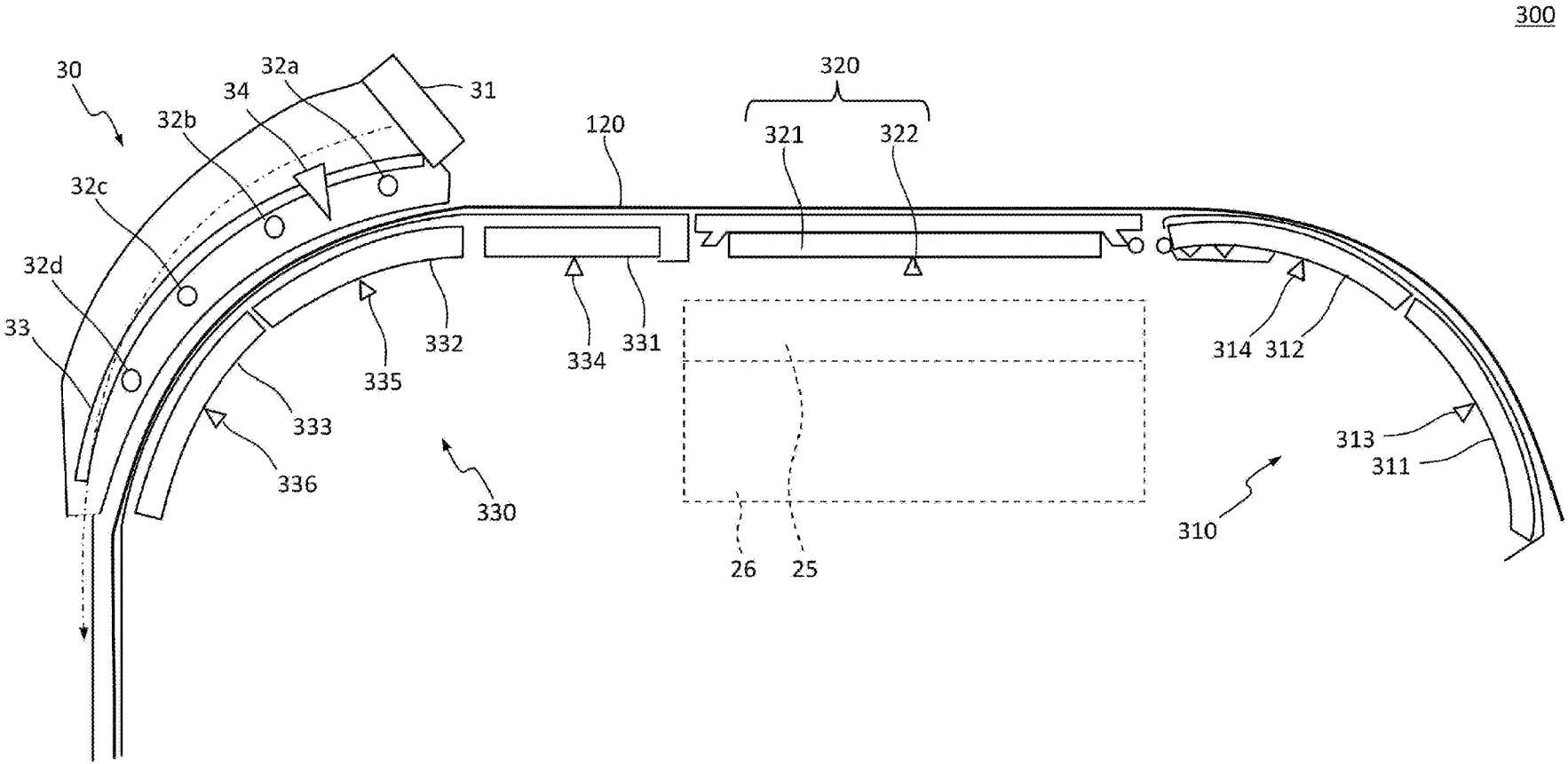
FIG. 4 is a cross-sectional view illustrating a schematic configuration of a heating dryer according to the embodiment of the present disclosure.

A configuration of the heating dryer 300 according to the present disclosure is next described. FIG. 4 is a view illustrating an example of a schematic configuration of the heating dryer 300 according to the present disclosure. The heating dryer 300 includes a pre-heater 310 (first heater), a print-heater 320 (second heater), a post-heater 330 (third heater), and the liquid dryer 30.

The pre-heater 310 includes a first pre-heater 311 and a second pre-heater 312 as heating elements, and a first pre-heater temperature sensor 313 and a second pre-heater temperature sensor 314 as temperature detecting units which detect temperature of the heating elements. Although FIG. 4 illustrates a configuration including two heaters, the pre-heater 310 may also include two or more heaters. One pre-heater temperature sensor is provided for each pre-heater.

The pre-heater 310 is arranged at a first position disposed upstream in the conveyance direction of the roll paper 120. The pre-heater 310 heats the roll paper 120 at the first position before the roll paper 120 is conveyed to a range scanned by the carriage 5. Since the pre-heater 310 heats the roll paper 120 before the image is formed on the roll paper 120, the liquid on the roll paper 120 may be easily evaporated when the image forming device 104 forms the image.

The print-heater 320 includes a first print-heater 321 as a heating element and a first print-heater temperature sensor 322 serving as a temperature detecting unit which detects temperature of the heating element in the order of the first print-heater temperature sensor 322 and the first print-heater 321 from an upstream side in the conveyance direction of the roll paper 120. As with the pre-heater 310, the print-heater 320 may also include two or more heaters to form the print-heater 320. One print-heater temperature sensor is provided for one print-heater.

The print-heater 320 is arranged immediately below the range scanned by the carriage 5 in the image forming device 104. The conveyance guide member 25 and the suction fan 26 are arranged below the print-heater 320.

The print-heater 320 heats the roll paper 120 at the same time as the liquid is discharged from the carriage 5, so that a film is formed on a surface of the liquid discharged from the carriage 5. When the film is formed on the liquid, the liquid is suppressed from spreading, so that coalescence of liquid and ink leakage may be prevented.

The post-heater 330 includes a first post-heater 331, a second post-heater 332, and a third post-heater 333 as heating elements, and a first post-heater temperature sensor 334, a second post-heater temperature sensor 335, and a third post-heater temperature sensor 336 as temperature detecting units which detect temperature of the heating elements in the order of the first post-heater 331, the second post-heater 332, and the third post-heater 333 from the upstream side in the conveyance direction of the roll paper 120. The post-heater 330 may also include two or more heaters to form the post-heater 330 as in the pre-heater 310. One post-heater temperature sensor is provided for one post-heater.

The post-heater 330 is arranged at a third position at which the post-heater 330 heats the roll paper 120 after scanned by the carriage 5 in the image forming device 104. Since the post-heater 330 heats the roll paper 120 after the image is formed on the roll paper 120, the liquid on the roll paper 120 may be dried when the image forming device 104 forms the image.

The liquid dryer 30 includes a fan 31, infrared heaters 32*a*, 32*b*, 32*c*, and 32*d*, a reflector 33, and a temperature sensor 34. The liquid dryer 30 accelerates polymerization reaction of colorants such as the ink discharged onto the roll paper 120 by the infrared heaters 32*a*, 32*b*, 32*c*, and 32*d*, and cures the colorants.

As described above, the inkjet recording apparatus 100 according to the present disclosure conveys the roll paper 120 in a heated state from before to after the liquid is discharged onto the roll paper 120 in the image forming device 104.

Thus, the liquid dryer 30 according to the present disclosure can reduce a drastic temperature change in the roll paper 120 on a conveyance path, and thus can reduce expansion and temperature unevenness of the roll paper 120 in the heating dryer 300 at the time of drying the roll paper 120.

Figure 5:
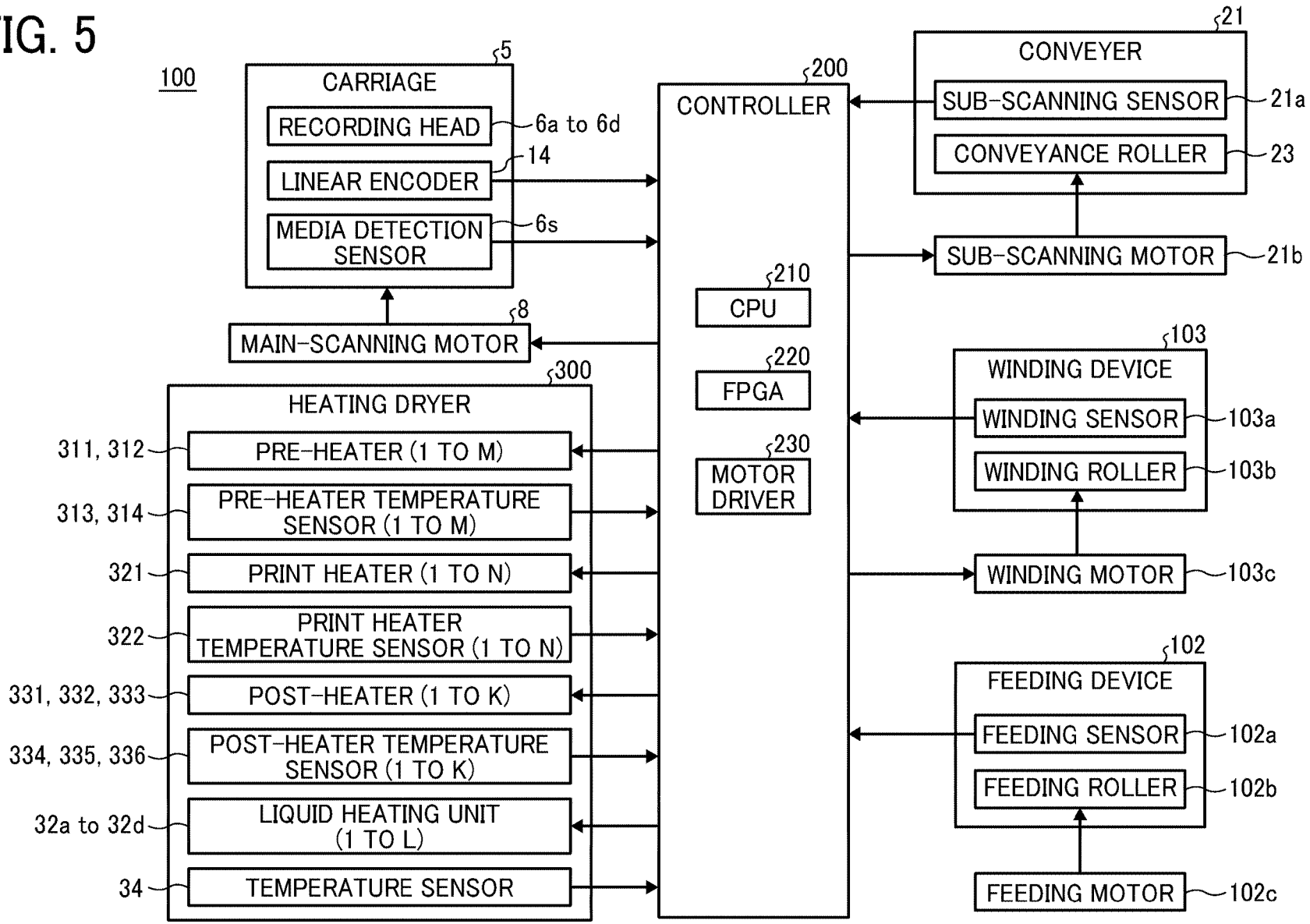
FIG. 5 is a functional block diagram illustrating an overview of a controller according to the embodiment of the present disclosure.

A configuration of controlling temperature of the pre-heater 310, the print-heater 320, and the post-heater 330 forming the heating dryer 300 is next described. FIG. 5 is a functional block diagram illustrating a control mechanism of the inkjet recording apparatus 100 according to the present disclosure. As for the configuration heretofore described, the same reference sign is assigned in FIG. 5, and the description is not repeated.

The inkjet recording apparatus 100 is controlled by the controller 200 which implements an arithmetic function, a liquid discharge control function, a sensor signal detection function, and a motor driving control function. The controller 200 includes a central processing unit (CPU) 210, a field-programmable gate array (FPGA) 220, and a motor driver 230.

The arithmetic function, liquid discharge control function, sensor signal detection function, and motor driving control function implemented in the inkjet recording apparatus 100 are implemented by cooperation of the CPU 210 and the FPGA 220. The CPU 210 controls operation of each motor mounted on the inkjet recording apparatus 100 using the motor driver 230 corresponding to each motor.

The controller 200 to which output values of the linear encoder 14 and the media detection sensor 6*s* are input detects the position and speed of the carriage 5 based on the output values. The controller 200 controls the main-scanning motor 8 based on the detected position and speed of the carriage 5.

The conveyance amount of the roll paper 120 detected by the sub-scanning sensor 21*a* is input to the controller 200. The controller 200 controls the sub-scanning motor 21*b* based on the input conveyance amount of the roll paper 120.

The winding amount of the roll paper 120 detected by the winding sensor 103*a* is further input to the controller 200. The controller 200 controls the winding motor 103*c* based on the input winding amount of the roll paper 120.

The feeding amount of the roll paper 120 detected by the feeding sensor 102*a* is further input to the controller 200. The controller 200 controls the feeding motor 102*c* based on the input feeding amount of the roll paper 120.

Then, a value of the temperature detected by each temperature sensor included in the heating dryer 300 is input to the controller 200. Specifically, temperature values of the first pre-heater 311 and the second pre-heater 312 detected by the first pre-heater temperature sensor 313 and the second pre-heater temperature sensor 314, respectively, a temperature value of the first print-heater 321 detected by the first print-heater temperature sensor 322, temperature values of the first post-heater 331, the second post-heater 332, and the third post-heater 333 detected by the first post-heater temperature sensor 334, the second post-heater temperature sensor 335, and the third post-heater temperature sensor 336, respectively, and a value of surface temperature of the roll paper 120 conveyed in the liquid dryer 30 detected by the temperature sensor 34 are input to the controller 200.

Figure 6:
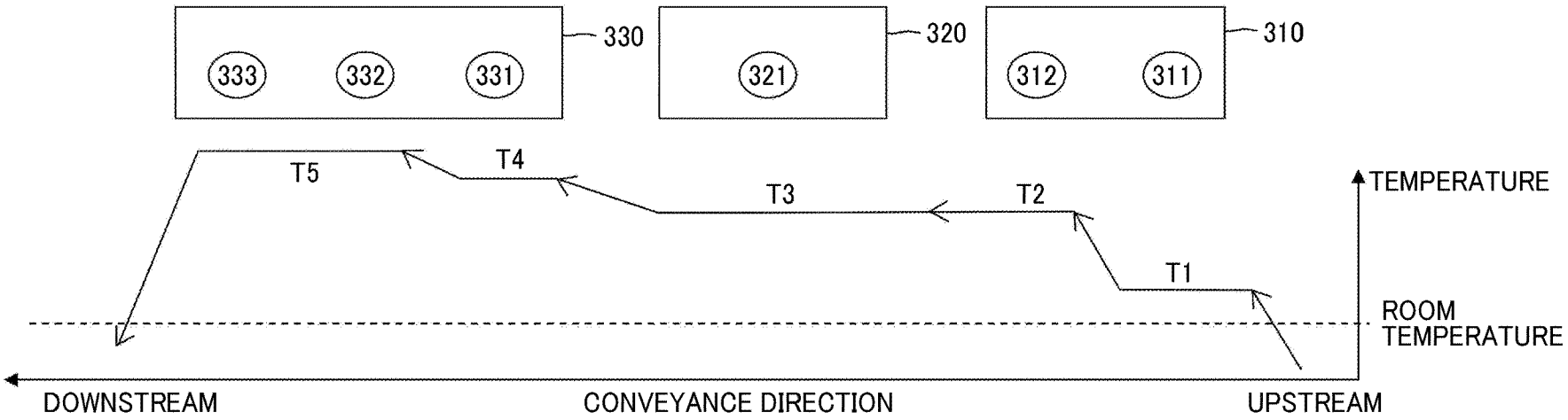
FIG. 6 is an explanatory view for explaining an aspect of temperature control of a dryer according to the embodiment of the present disclosure.

Based on the above-described temperature values, the controller 200 controls the temperature of each unit forming the heating dryer 300 as illustrated in FIG. 6. FIG. 6 is a view illustrating temperature distribution of the heating dryer 300 according to the present disclosure.

As illustrated in FIG. 6, the controller 200 controls the temperature of the first pre-heater 311 to be lower than the temperature of the second pre-heater 312 (for example, temperature close to room temperature), and controls the temperature of the second pre-heater 312 (first adjacent site, first adjacent heating element) adjacent to the print-heater 320 to be closer to the temperature of the first print-heater 321. Therefore, the controller 200 serves as a temperature controller.

The controller 200 controls the temperature of the second pre-heater 312 to a value between the temperature of the first pre-heater 311 (first separated site, first separated heating element) separated from the print-heater 320 and the temperature of the first print-heater 321 (for example, intermediate temperature between the temperature of the first pre-heater 311 and the temperature of the first print-heater 321).

In the above-described manner, the temperature change of the roll paper 120 conveyed through the pre-heater 310 which is a first heater unit becomes mild, so that the expansion of the roll paper 120 caused by the temperature change may be reduced. The print-heater 320 is a second heater unit.

As illustrated in FIG. 6, the controller 200 sets the temperature of the first post-heater 331 to be higher than the temperature of the first print-heater 321 (for example, higher than the temperature of the first print-heater 321 by five degrees), and sets the temperature of the second post-heater 332 to be higher than the temperature of the first post-heater 331 (second adjacent site, second adjacent heating element).

The controller 200 controls the temperature of the first post-heater 331 adjacent to the print-heater 320 to a value between the temperature of the second post-heater 332 (second separated site, second separated heating element) separated from the print-heater 320 and the temperature of the first print-heater 321 (for example, intermediate temperature between the temperature of the second post-heater 332 and the temperature of the first print-heater 321).

In the above-described manner, the temperature change of the roll paper 120 conveyed through the post-heater 330 which is a third heater unit becomes mild, so that the expansion of the roll paper 120 caused by the temperature change may be reduced.

Figure 7:
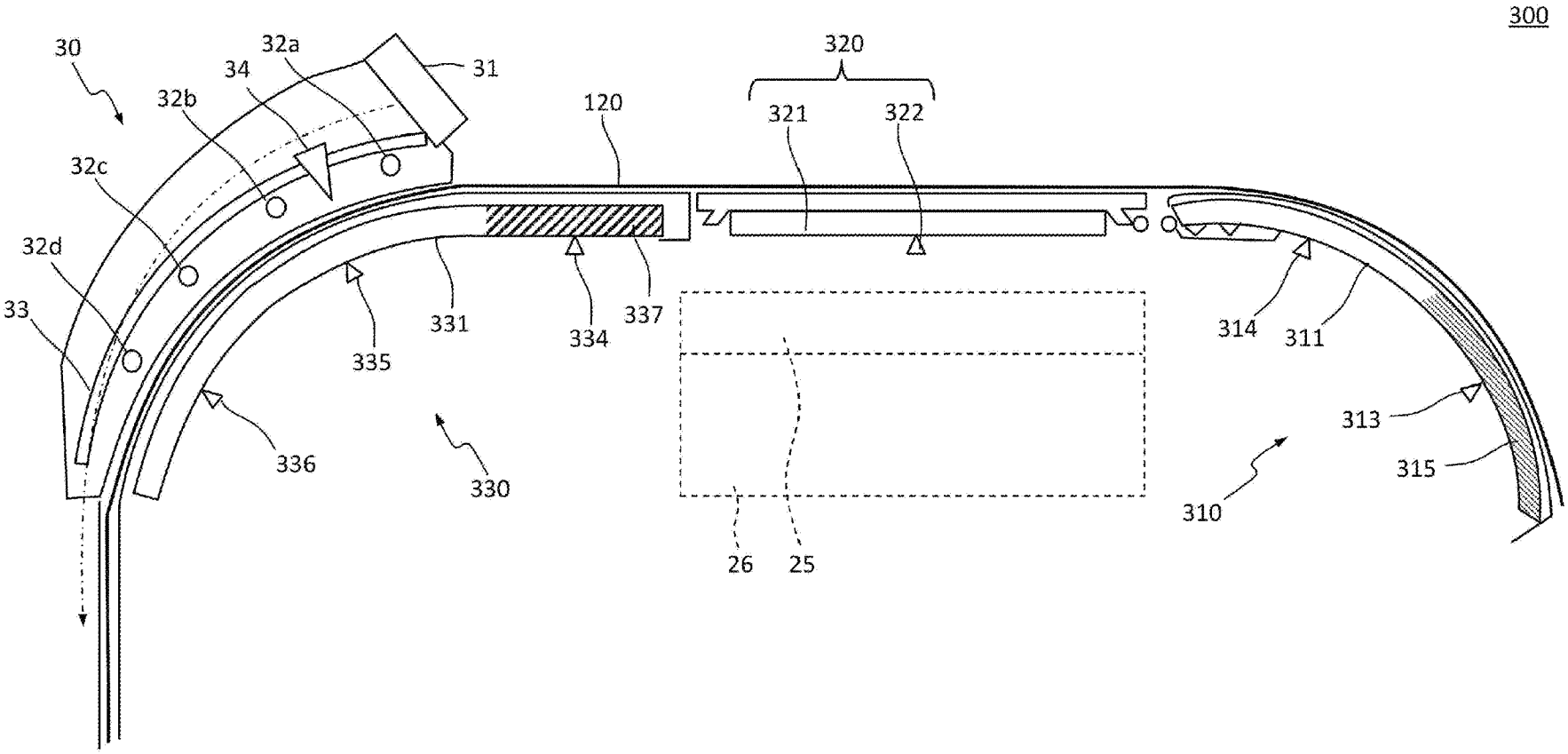
FIG. 7 is a cross-sectional view illustrating a schematic configuration of a heating dryer according to the embodiment of the present disclosure.

As illustrated in FIG. 7, the pre-heater 310 and the post-heater 330 may also include peripheral members 315 and 337 made of a material having a thermal conductivity different from a thermal conductivity of the heater. FIG. 7 is a view illustrating another example of a schematic configuration of the heating dryer 300 according to the present disclosure.

In the heating dryer 300 illustrated in FIG. 7, a material having a thermal conductivity different from a thermal conductivity of the first pre-heater 311 (for example, zirconia and glass cotton) is provided on the first pre-heater 311 as the peripheral member 315. A material having a thermal conductivity different from the thermal conductivity of the first post-heater 331 is further provided on the first post-heater 331 as the peripheral member 337.

For example, when the first pre-heater 311, the first print-heater 321, and the first post-heater 331 are made of materials having the same thermal conductivity, the temperature of the roll paper 120 may be controlled to obtain the temperature distribution as illustrated in FIG. 6 by providing the peripheral members 315 and 337.

In FIG. 7, in addition, for example, when the first pre-heater 311, the first print-heater 321, and the first post-heater 331 are made of materials having thermal conductivities in ascending order (the first post-heater 331 has the highest thermal conductivity), the peripheral member 315 may be provided so that the thermal conductivity of the first pre-heater 311 increases toward the first print-heater 321. The peripheral member 337 may be provided so that the thermal conductivity of the first post-heater 331 decreases toward the first print-heater 321.

In above-described manner, the temperature of the first pre-heater 311 on the side adjacent to the first print-heater 321 (first adjacent site) may be made the intermediate value between the temperature of the first pre-heater 311 on the side separated from the first print-heater 321 (first separated site) and the temperature of the first print-heater 321.

The heating dryer 300 includes circuitry (controller 200) controls the temperature of each of the pre-heater 310, the print-heater 320, and the post-heater 330 to gradually increase from the pre-heater 310 to the post-heater 330 via the print-heater 320. The thermal conductivity of each of the pre-heater 310, the print-heater 320, and the post-heater 330 may gradually decrease from the pre-heater 310 to the post-heater 330 via the print-heater 320.

Further, the circuitry (controller 200) controls the temperature of the first pre-heater 311 to be lower than the temperature of the second pre-heater 312, and controls the temperature of the first post-heater 331 to be lower than the second post-heater 332.

The temperature of the first post-heater 331 on the side adjacent to the first print-heater 321 (second adjacent site) may be made the intermediate value between the temperature of the first post-heater 331 on the side separated from the first print-heater 321 (second separated site) and the temperature of the first print-heater 321.

The present disclosure is not limited to the described embodiment, and changes may be made within the scope conceivable by those skilled in the art such as other embodiments, additions, modifications, and deletions. All the aspects are included in the scope of the present disclosure as long as the functions and effects of the present disclosure are exhibited.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the embodiments may be varied in many ways. Such modifications and variations are not to be regarded as a departure from the scope of the present disclosure and appended claims, and all such modifications are intended to be included within the scope of the present disclosure and appended claims.

What is claimed is:

1. A heating device comprising:

a pre-heater configured to pre-heat a medium, onto which a liquid is discharged from a liquid discharger, at a first position upstream of the liquid discharger in a conveyance direction of the medium;

a print-heater configured to heat the medium at a second position opposite the liquid discharger;

a post-heater configured to post-heat the medium at a third position downstream of the second position in the conveyance direction; and circuitry configured to control a temperature of each of the pre-heater, the print-heater, and the post-heater, wherein the pre-heater includes a first pre-heater and a second pre-heater disposed closer to the print-heater than the first pre-heater, and the circuitry controls a temperature of the second pre-heater to be between a temperature of the first pre-heater and the temperature of the print-heater, wherein the circuitry controls the temperature of each of the pre-heater, the print-heater, and the post-heater to gradually increase from the pre-heater to the post-heater via the print-heater.

2. The heating device according to claim 1, wherein the circuitry controls the temperature of the second pre-heater to be an intermediate temperature between the temperature of the first pre-heater and the temperature of the print-heater.

3. The heating device according to claim 1, wherein the pre-heater includes a peripheral member having a different thermal conductivity from a thermal conductivity of the first pre-heater.

4. The heating device according to claim 3, wherein the thermal conductivity of the peripheral member in the pre-heater increases toward the print-heater.

5. The heating device according to claim 1, wherein the pre-heater includes a plurality of heating elements.

6. The heating device according to claim 1, wherein the post-heater includes a first post-heater adjacent to the print-heater and a second post-heater disposed farther from the print-heater than the first post-heater, and the circuitry controls a temperature of the first post-heater to be between a temperature of the second post-heater and the temperature of the print-heater.

7. The heating device according to claim 6, wherein the circuitry controls the temperature of the first post-heater to be an intermediate temperature between the temperature of the second post-heater and the temperature of the print-heater.

8. The heating device according to claim 6, wherein the post-heater includes a peripheral member having a different thermal conductivity from a thermal conductivity of the first post-heater.

9. The heating device according to claim 8, wherein the thermal conductivity of the peripheral member in the post-heater decreases toward the print-heater.

10. The heating device according to claim 6, wherein at least one of the pre-heater and the post-heater includes a plurality of heating elements.

11. The heating device according to claim 6, wherein the circuitry controls the temperature of the first pre-heater to be lower than the temperature of the second pre-heater, and controls the temperature of the first post-heater to be lower than the second post-heater.

12. The heating device according to claim 1, wherein thermal conductivity of each of the pre-heater, the print-heater, and the post-heater gradually decreases from the pre-heater to the post-heater via the print-heater.

13. A liquid discharge apparatus comprising the heating device according to claim 1.

14. A heating device comprising:

a pre-heater configured to pre-heat a medium, onto which a liquid is discharged from a liquid discharger, at a first position upstream of the liquid discharger in a conveyance direction of the medium;

a print-heater configured to heat the medium at a second position opposite the liquid discharger downstream of the first position;

a post-heater configured to post-heat the medium at a third position downstream of the second position in the conveyance direction; and circuitry configured to control a temperature of each of the pre-heater, the print-heater, and the post-heater, wherein the post-heater includes a first post-heater adjacent to the print-heater and a second post-heater disposed farther from the print-heater than the first post-heater, and the circuitry controls a temperature of the first post-heater to be between a temperature of the second post-heater and the temperature of the print-heater, wherein the circuitry controls the temperature of each of the pre-heater, the print-heater, and the post-heater to gradually increase from the pre-heater to the post-heater via the print-heater.

* * * * *